US007253352B2

(12) United States Patent
Hsieh et al.

(10) Patent No.: US 7,253,352 B2
(45) Date of Patent: Aug. 7, 2007

(54) MUSIC PLAYING/PROCESSING DEVICE AND METHOD FOR PLAYING MUSIC FILE ACCORDING TO PLAYING ORDER OF TONES

(75) Inventors: I-Hung Hsieh, Hsin-Chu (TW); Hung-Ming Chang, Hsin-Chu (TW); Hsi-Wen Nien, Hsin-Chu (JP)

(73) Assignee: Mediatek Inc., Hsin-Chu (TW)

( * ) Notice: Subject to any disclaimer, the term of this patent is extended or adjusted under 35 U.S.C. 154(b) by 0 days.

(21) Appl. No.: 10/843,313

(22) Filed: May 12, 2004

(65) Prior Publication Data

US 2004/0226434 A1 Nov. 18, 2004

(30) Foreign Application Priority Data

May 14, 2003 (TW) ..... 92113133 A

(51) Int. Cl.
*G10H 7/00* (2006.01)

(52) U.S. Cl. ..... 84/627; 84/604; 84/615; 84/625

(58) Field of Classification Search ..... 84/627, 84/615, 604, 625
See application file for complete search history.

(56) References Cited

U.S. PATENT DOCUMENTS 3,952,623 A * 4/1976 Deutsch ..... 84/629
5,604,323 A * 2/1997 Hardie-Bick ..... 84/604
5,814,751 A * 9/1998 Imamura ..... 84/604
6,184,455 B1 * 2/2001 Tamura ..... 84/625
2002/0102960 A1 * 8/2002 Lechner ..... 455/401
2003/0128834 A1 * 7/2003 Laine ..... 379/374.01
2003/0131719 A1 * 7/2003 Kubita ..... 84/615

* cited by examiner

*Primary Examiner*—Lincoln Donovan
*Assistant Examiner*—Christina Russell
(74) *Attorney, Agent, or Firm*—Troxell Law Office, PLLC

(57) ABSTRACT

The present invention relates to a music playing/processing device for playing a musical file in a wireless communication device and determining the playing order of a plurality of tones of the musical file. The music playing/processing device comprises: an analysis module for receiving the musical file and analyzing a waveform corresponding to each of the tones to generate a plurality of order parameters of each of the tones; a sorting module for arranging a playing order to play the tones according to the order parameters of each of the tones; and a playing module for playing the tones according to the playing order. The music playing/processing device of the present invention is provided to reduce the tone commands to be executed and to make the digital signal processor use less memory to execute the wavetable synthesis operation, and to make the performance of the music as perfect as possible.

15 Claims, 5 Drawing Sheets

MUSIC PLAYING/PROCESSING DEVICE AND METHOD FOR PLAYING MUSIC FILE ACCORDING TO PLAYING ORDER OF TONES

BACKGROUND OF THE INVENTION

1. Field of the Invention

The present invention relates to a music playing/processing device, especially to a music playing/processing device applied in a wireless communication device.

2. Description of the Prior Art

The multimedia message service (MMS), as its name implies, is utilized for transmitting messages with multimedia contents, comprising various colorful pictures, animations, and sounds (including general ring tones, chord ring tones, self-recorded ring tones, which depends on the capabilities of cellular phones). While the network transmission speed allows, even a short video clip may be transmitted. Compared with the MMS, the conventional short message service (SMS) can only transmit relatively smaller texts and some basic and simple pictures.

As the technology advances, multimedia message service (MMS) has been gradually utilized in the present communication system nowadays, providing more vivid messages with more plentiful contents. However, a more powerful device with greater capacity is required. The wavetable synthesis technology, which is an electronic synthesis technology, is developed to meet the requirement. In this technology, the sounds of the music instruments are sampled and digitized to be burned on a synthesis chip (or to be stored as disc files) for sound simulation. Because it is a string of waveforms being recorded, the microprocessor on the sound card is needed to generate loops and repeats in order to play back the sound samples.

Due to the diversity of the multimedia data, many limitations still exist in the current system structure, especially the micro controller unit and digital signal processor. The micro controller unit comprises the major components of a computer, which are the central processing unit (CPU), memory, and output/input unit. Structurally, the micro controller unit is just like a simple computer for executing control functions. The digital signal processor is a processor that can process digital signals in high speed with an instant and fast calculation function. When a lot of data are transmitted in, the capacity of the micro controller unit cannot make the execution of the control functions performed in an adequate speed, and the digital signal processor doest not have the sufficient memory to execute commands, generating a heavy load for the processing capability. Generally speaking, when the digital signal processor receives a lot of tasks at the same time, the task with high priority will be processed first. However, the priority of musical files is the lowest. The loading of the digital signal processor of the cellular phone is different all the time. If it is designed that the wavetable synthesis technology only can utilize the remained processing capability of the digital signal processor to execute, its performance will not be good. What's more, the performance will be very bad while the remained processing capability is insufficient. The present technology tries to solve the above problems by continuously promoting the processing speed and capability of the micro controller unit and the digital signal processor for handling the more complex multimedia data. However, as cellular phones tend to be smaller and smaller, it is getting more and more difficult to bring about technological breakthrough, and the cost of production is getting higher. The present invention provides a music playing/processing device for improving the efficiency of the digital signal processor of the execution of the wavetable synthesis operation. In this way, the wavetable synthesis technology can make full use of the remained processing capability of the digital signal processor so as to avoid introducing too much noise and to reduce the number of tone commands to be executed. Furthermore, the digital signal processor can use less memory to execute synthesis operation, and the performance of the music can be as perfect as possible.

SUMMARY OF THE INVENTION

The objective of the present invention is to provide a music playing/processing device applied in a wireless communication device to solve the problems of the prior art.

The present invention is a music playing/processing device for determining the playing order of each of the tones by analyzing and sequencing each of the tones of the music file to be played. The remained processing capability of the digital signal processor is limited after processing the tasks with higher priority, and therefore, the present invention is provided to avoid introducing too much noise, and to reduce the number of tone commands to be executed. Furthermore, the present invention makes the digital signal processor capable of using less memory to execute synthesis operation, and makes the performance of the music as perfect as possible.

The music playing/processing device of the present invention is used for playing a musical file in a wireless communication device and for determining the playing order of a plurality of tones of the musical file. The music playing/processing device comprises: an analysis module for receiving the musical file and analyzing a waveform corresponding to each of the tones so as to generate a plurality of order parameters for each of the tones; a sorting module for arranging a playing order to play the tones according to the order parameters of each of the tones; and a playing module for playing the tones according to the playing order.

The advantage and spirit of the invention may be understood by the following recitations together with the appended drawings.

BRIEF DESCRIPTION OF THE APPENDED DRAWINGS

DETAILED DESCRIPTION OF THE INVENTION

Figure 1:
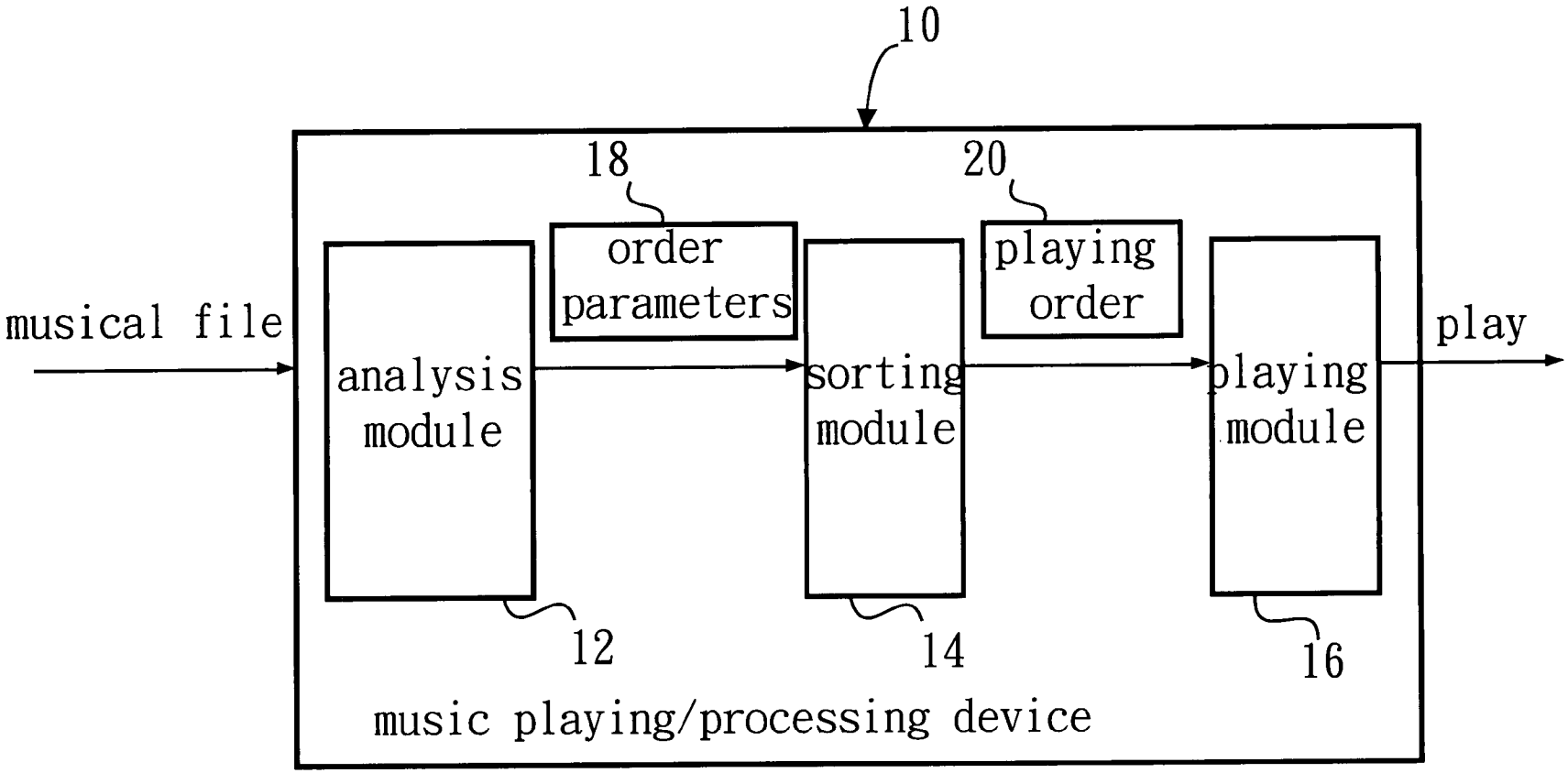
FIG. 1 is a schematic diagram of a music playing/processing device of the present invention.

Please refer to FIG. 1. FIG. 1 is a schematic diagram of a music playing/processing device 10 of the present invention. The music playing/processing device 10 of the present invention is used for playing a musical file in a wireless communication device and determining the playing order of a plurality of tones of the musical file. The music playing/processing device 10 comprises an analysis module 12, a sorting module 14, and a playing module 16. The analysis module 12 is used for receiving the musical file and analyzing the waveforms corresponding to each of the tones to generate a plurality of order parameters 18 for each tone. The sorting module 14 is used for arranging a playing order 20 to play the tones according to the order parameters 18 of each tone. The playing module 16 is used for playing the tones according to the playing order 20. Furthermore, the playing module 16 is set with a threshold time, and it only plays the tones which can be completely played before the threshold time according to the playing order 20. As a whole, after the analysis module 12 receives the musical file, the analysis module 12 will analyze the waveform corresponding to each of the tones in the musical file so as to generate the order parameters 18 for each tone. After the sorting module 14 receives the order parameters 18, the sorting module 14 will arrange a playing order 20 to play the tones according to the order parameters 18 for each tone. After the playing module 16 receives the playing order 20, the playing module 16 will play the corresponding tones according to the playing order 20.

Figure 2:
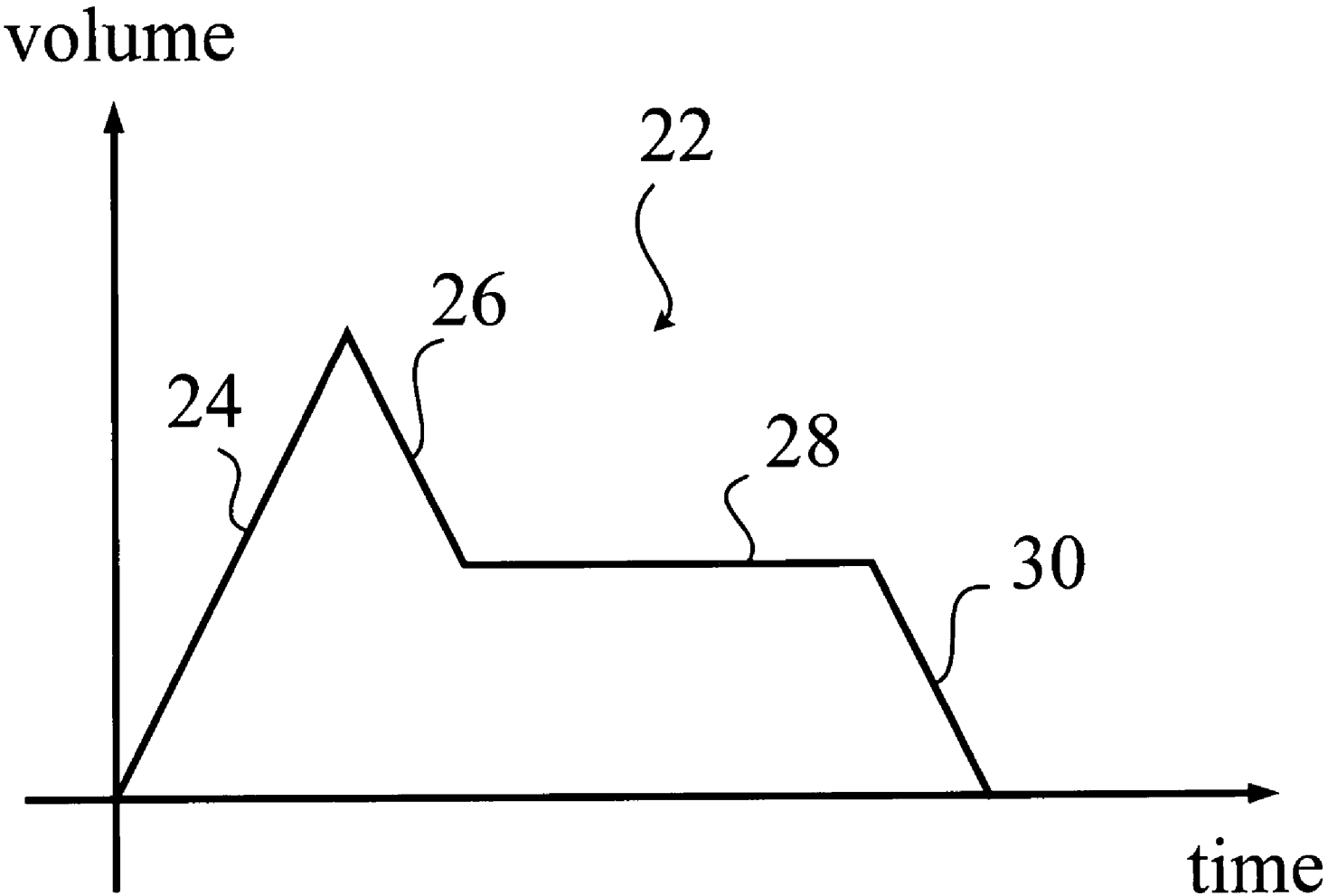
FIG. 2 is a waveform diagram of the waveform according to the present invention.

Please refer to FIG. 1 and FIG. 2. FIG. 2 is a waveform diagram of the envelope 22 according to the present invention. The envelope 22 is used for depicting the approximate outline of a tone waveform of a corresponding tone to show the characteristic of the volume variation of the tone. An envelope 22 is described with four parameters: an attack 24, a decay 26, a sustain 28, and a release 30. The four parameters are so-called ADSR. Because the envelope 22 is used for describing the volume variation of the tone from being plucked to being released, the envelope 22 is also called as time variable amplitude (TVA). The order parameters 18 generated by the analysis module 12 are selected from a group composed of at least one of the followings: the attack 24, the decay 26, the sustain 28, the release 30, and the amplitude corresponding to each tone. Then, according to the order parameters 18, the sorting module 12 will arrange a playing order 20 to play the tones by the playing module 16.

Figure 3:
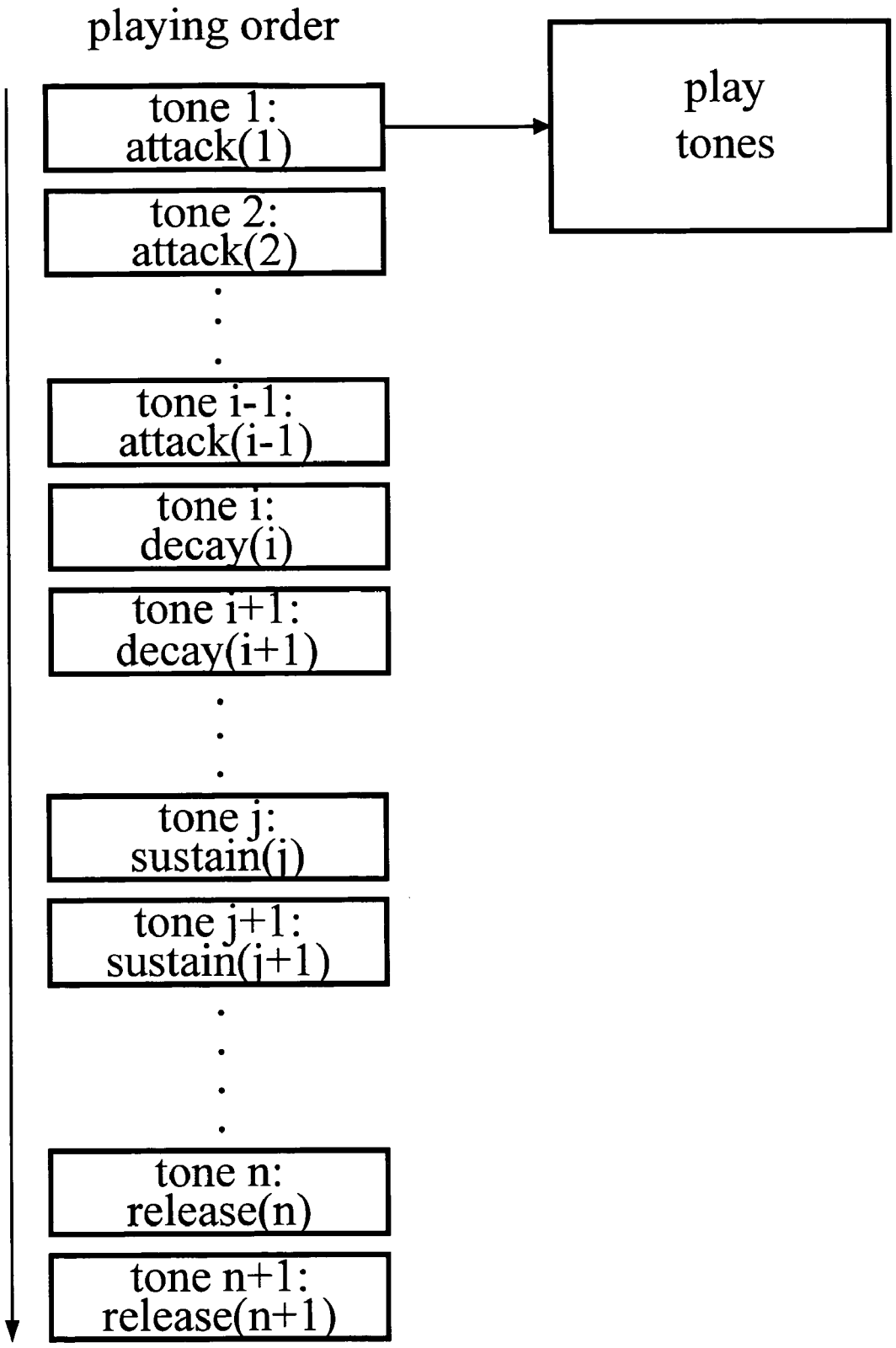
FIG. 3 is a schematic diagram of tone playing of the first embodiment according to the present invention.

Please refer to FIG. 3. FIG. 3 is a schematic diagram of tone playing of the first embodiment according to the present invention. The sorting module 14 arranges the playing order 20 according to the appearance order of the corresponding attack 24 of each of the tones, which is the order parameter 18. In the first embodiment, the attack 24 of each of the tones is sorted first, and then the decay 26, sustain 28, and release 30 of each of the tones will be sorted sequentially. As shown in FIG. 3, attack(1), attack(2), . . . , attack(i−1) represent the magnitudes of the envelope of the attack 24 during the time period of the attack 24. The greater is the value of the envelope 22 of the attack 24, the higher is the priority of its corresponding tone. In the same way, decay(i), decay(i+1), . . . represent the magnitudes of the envelope 22 of the decay 26 during the time period of the decay 26. Sustain(j), sustain(j+1), . . . represent the magnitudes of the envelope 22 of the sustain 28 during the time period of the sustain 28. Release(n), release(n+1), . . . represent the magnitudes of the envelope 22 of the release 30 during the time period of the release 30. After the sorting is finished, the corresponding tones are played according to the priorities.

Figure 4:
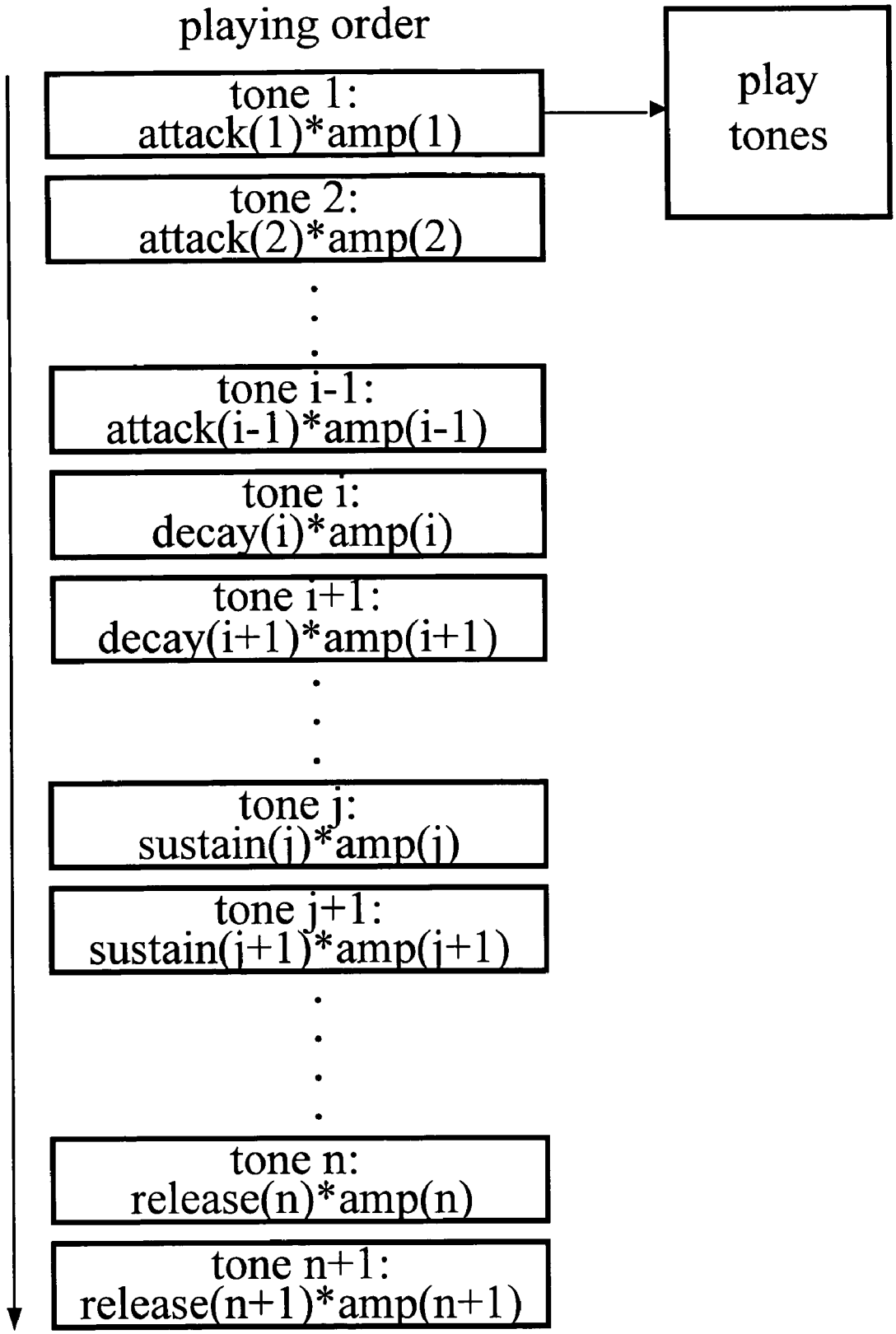
FIG. 4 is a schematic diagram of tone playing of the second embodiment according to the present invention.

Please refer to FIG. 4. FIG. 4 is a schematic diagram of tone playing of the second embodiment according to the present invention. The sorting module 14 multiplies the corresponding attack 24 of each tone by the amplitude of each tone so as to generate the corresponding order parameters 18 of each tone. Then, according to the magnitudes of the order parameters 18, the sorting module 14 will arrange the playing order 20. In the second embodiment, the sorting of the values generated by multiplying the corresponding attack 24 of each tone by the amplitude of each tone is first performed. The greater is the value, the higher is the priority of the corresponding tone. Then, the sorting of the values generated by multiplying the corresponding decay 26 of each tone by the amplitude of each tone, the sorting of the values generated by multiplying the corresponding sustain 28 of each tone by the amplitude of each tone, and the sorting of the values generated by multiplying the corresponding release 30 of each tone by the amplitude of each tone are performed sequentially. FIG. 4 is represented in the same manner as FIG. 3, wherein amp(1), amp(2), . . . represent the amplitudes of the corresponding tones.

Figure 5:
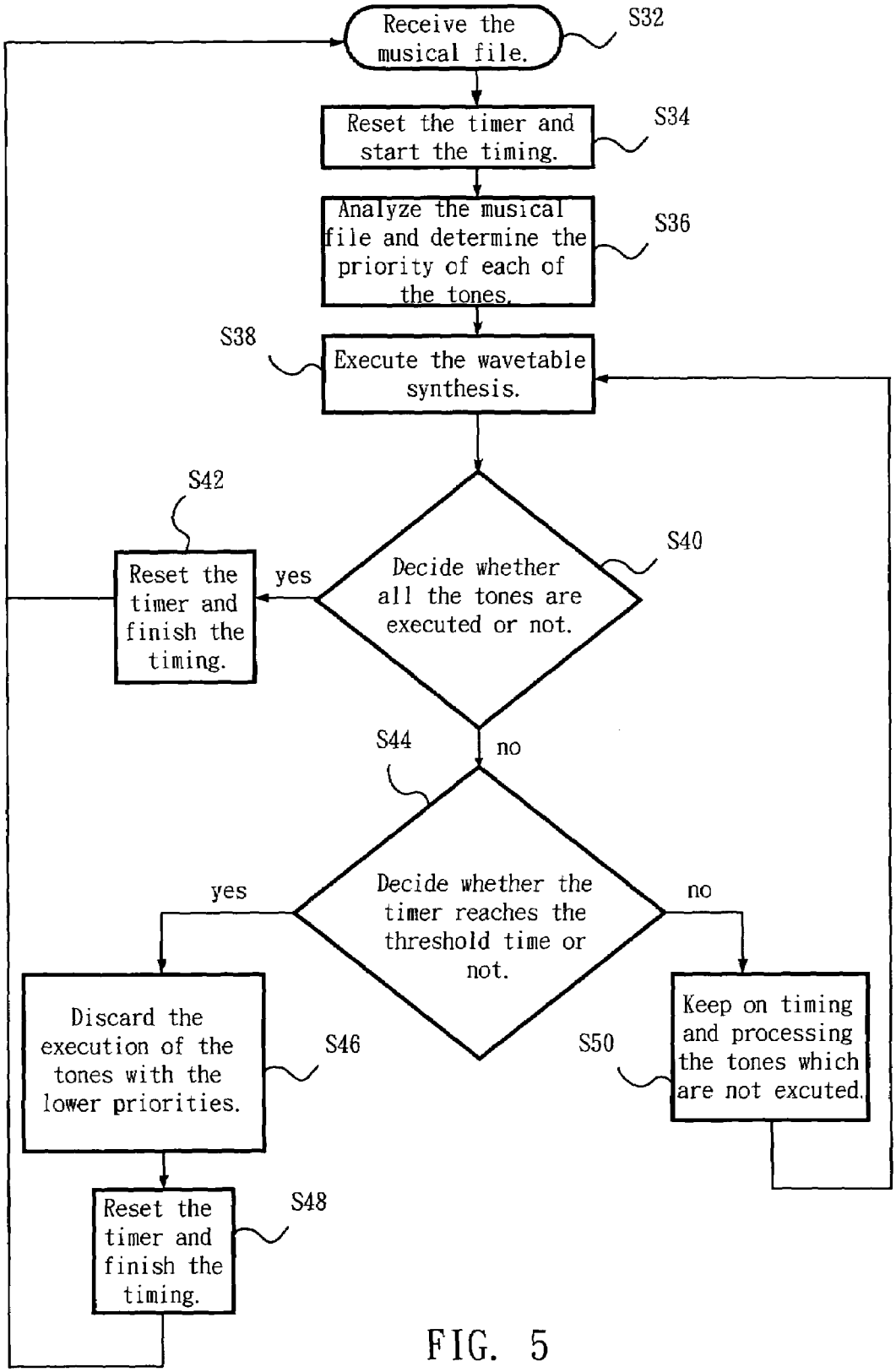
FIG. 5 is a flowchart of executing method of the present invention.

Please refer to FIG. 5. FIG. 5 is a flowchart of an executing method of the present invention. According to the above description, the executing method of the present invention comprises the following steps:

Step S32: Start and receive the musical file.

Step S34: Reset the timer, and start the timing.

Step S36: Analyze the musical file and determine the priority of each of the tones of the musical file.

Step S38: Execute the wavetable synthesis.

Step S40: Decide whether all the tones are completely executed. If yes, go to step S42; if no, go to step S44.

Step S42: Reset the timer, finish the timing, and repeat step S32.

Step S44: Decide whether the timer reaches the threshold time. If yes, go to step S46; if no, go to step S50.

Step S46: Discard the execution of the tones with the lower priorities.

Step S48: Reset the timer and finish the timing.

Step S50: The timer keeps on timing, :and the music playing/processing device keeps on processing the tones which are not executed, and repeat S38.

In another embodiment (not shown), the tones which have the lower priorities and are discarded in the step S46 can be executed when the whole process is restarted.

In the prior art, when processing the musical file, the music playing/processing device will sequentially process the entire envelope of each of the tones in the musical file, including the attack, decay, sustain, and release, so as to completely play each of the tones. Though the prior art can generate complete music, huge and powerful capabilities of the micro controller unit and the digital signal processor are required due to the complication of the music, which is a mixture of various tones (for example, the music comprises the tones of flute, drumbeat, piano, violin, . . . at the same time). Furthermore, because the priority of the musical file is the lowest, it is common that the music will be interrupted during the playing, or even cannot be played. Compared with the prior art, the music playing/processing device of the present invention can make full use of the remained processing capability of the digital signal processor, avoid introducing too much noise, and reduce the number of the tone commands to be executed. Furthermore, the present invention is provided to make the digital signal processor use less memory to execute the synthesis operation, and make the performance of the music as perfect as possible.

With the example and explanations above, the features and spirits of the invention will be hopefully well described. Those skilled in the art will readily observe that numerous modifications and alterations of the device may be made while retaining the teaching of the invention. Accordingly, the above disclosure should be construed as limited only by the metes and bounds of the appended claims.

What is claimed is:

1. A music playing/processing device for playing a musical file in a wireless communication device and determining the playing order of a plurality of tones of the musical file, each of the tones comprising a corresponding envelope, the envelope comprising the portions of an attack, a decay, a sustain, and a release, the music playing/processing device comprising:

an analysis module for receiving the musical file; and analyzing a waveform corresponding to each of the tones to generate a plurality of order parameters of each of the tones, wherein the order parameters are related to the portions of the attack, the decay, the sustain, and the release of the envelope of each of the tones;

a sorting module for arranging a playing order for playing the tones according to the order parameters of each of the tones; and a playing module for playing the tones according to the playing order.

2. The music playing/processing device of claim 1, wherein each of the tones comprises a corresponding amplitude, the order parameters are further related to the amplitude of each of the tones.

3. The music playing/processing device of claim 2, wherein the sorting module multiplies the corresponding attack portion of each of the tones by the amplitude of each of the tones to generate a corresponding order value of each of the tones, and arranges the playing order according to the order values.

4. The music playing/processing device of claim 1, wherein the sorting module further arranges the playing order according to the appearance order of the corresponding attack portion of each of the tones.

5. The music playing/processing device of claim 1, wherein the playing module is set with a threshold time, and the playing module only plays the tones which can be completely played before the threshold time according to the playing order.

6. A tone sorting system for determining the playing order of a plurality of tones of a musical file while a processor in a wireless communication device playing the musical file, each of the tones comprising a corresponding envelope, the envelope comprising the portions of an attack, a decay, a sustain, and a release, the sorting system comprising:

an analysis module for receiving the musical file; and analyzing a waveform corresponding to each of the tones to generate a plurality of order parameters of each of the tones, wherein the order parameters are related to the portions of the attack, the decay, the sustain, and the release of the envelope of each of the tones; and a sorting module for arranging a playing order for playing the tones according to the order parameters of each of the tones.

7. The tone sorting system of claim 6, wherein each of the tones comprises a corresponding amplitude, the order parameters are further related to the amplitude of each of the tones.

8. The tone sorting system of claim 7, wherein the sorting module multiplies the corresponding attack portion of each of the tones by the amplitude of each of the tones to generate a corresponding order value of each of the tones, and arranges the playing order according to the order values.

9. The tone sorting system of claim 6, wherein the sorting module further arranges the playing order according to the appearance order of the corresponding attack portion of each of the tones.

10. A music playing/processing method for playing a musical file in a wireless communication device and determining the playing order of a plurality of tones of the musical file, each of the tones comprising a corresponding envelope, the envelope comprising the portions of an attack, a decay, a sustain, and a release, the music playing/processing method comprising:

receiving the musical file;

analyzing a waveform corresponding to each of the tones to generate a plurality of order parameters of the each tone, wherein the order parameters are related to the portions of the attack, the decay, the sustain, and the release of the envelope of each of the tones;

arranging a playing order as playing the tones according to the order parameters of the tones; and playing the tones according to the playing order.

11. The music playing/processing method of claim 10, wherein each of the tones comprises a corresponding amplitude, the order parameters are further related to the amplitude of each of the tones.

12. The music playing/processing method of claim 11, wherein the playing order is arranged according to order values of the tones, and the order value corresponding to each of the tone is generated by multiplying the corresponding attack portion of each of the tones by the amplitude of that.

13. The music playing/processing method of claim 10, wherein the playing order is further arranged according to the appearance order of the corresponding attack portion of each of the tones.

14. The music playing/processing method of claim 10, further comprising the following step:

setting a threshold time, the wireless communication device only playing the tones which can be completely played before the threshold time according to the playing order.

15. A music playing/processing device for playing a musical file in a wireless communication device and determining the playing order of a plurality of tones of the musical file, each of the tones comprising a corresponding amplitude and a corresponding envelope, the envelope comprising the portions of an attack, a decay, a sustain, and a release, the music playing/processing device comprising:

an analysis module for receiving the musical file; and analyzing a waveform corresponding to each of the tones to generate a plurality of order parameters of each of the tones, wherein the order parameters are related to the amplitude and the portions of the attack, the decay, the sustain, and the release of the envelope of each of the tones;

a sorting module for arranging a playing order for playing the tones according to the order parameters of each of the tones; and a playing module for playing the tones according to the playing order.

* * * * *